United States Patent [19]

Masaki

[11] Patent Number: 4,736,138

[45] Date of Patent: Apr. 5, 1988

[54] APPARATUS FOR LIMITING SURGE CURRENTS IN DC-ILLUMINATED INCANDESCENT LAMP

[75] Inventor: Kazumi Masaki, Osaka, Japan

[73] Assignee: Ken Hayashibara, Okayama, Japan

[21] Appl. No.: 830,474

[22] Filed: Feb. 18, 1986

[30] Foreign Application Priority Data

Feb. 20, 1985 [JP] Japan ..... 60-30615

[51] Int. Cl.[4] ..... H05B 37/02

[52] U.S. Cl. ..... 315/310; 315/107; 315/224; 315/307

[58] Field of Search ..... 315/102, 105, 107, 127, 315/224, DIG. 5, 307, 310, 311

[56] References Cited

U.S. PATENT DOCUMENTS

| | | | |
|---|---|---|---|
| 3,555,361 | 1/1971 | Hallberg | 361/58 |
| 3,644,783 | 2/1972 | Snyder | 315/127 |
| 3,886,405 | 5/1975 | Kubo | 315/224 |
| 3,989,976 | 11/1976 | Tabor | 315/DIG. 4 |
| 4,197,485 | 4/1980 | Nuver | 315/311 |
| 4,503,365 | 3/1985 | Kirk | 315/310 |
| 4,572,992 | 2/1986 | Masaki | 315/127 |

FOREIGN PATENT DOCUMENTS

| | | |
|---|---|---|
| 337681 | 11/1930 | United Kingdom . |
| 462970 | 3/1937 | United Kingdom . |
| 1059843 | 2/1967 | United Kingdom . |
| 2044563 | 10/1980 | United Kingdom . |
| 2046539 | 11/1980 | United Kingdom . |
| 1589663 | 5/1981 | United Kingdom . |
| 2144001 | 2/1985 | United Kingdom . |
| 2160723 | 12/1985 | United Kingdom . |

*Primary Examiner*—Harold Dixon

*Attorney, Agent, or Firm*—Browdy and Neimark

[57] ABSTRACT

Surge currents which may arise in dc-illuminated incandescent lamp can be effectively limited by an apparatus comprising a low resistance (first resistance); another resistance (second resistance); a diode rectifier, the input terminal being connected in series to an ac source through the first resistance, and the output terminal being connected in series to an incandescent lamp through the second resistance; a voltage regulator diode connected in parallel with said diode rectifier; a capacitance (first capacitance) connected in parallel to the input terminal of said diode rectifier; another capacitance (second capacitance) connected in parallel to the output terminal of said diode rectifier; a switching device connected to the second resistance; and a timing circuit connected to said switching device in a manner that the switching device shorts the second resistance after a lapse of a prescribed time upon switching-on of the ac source.

4 Claims, 1 Drawing Sheet

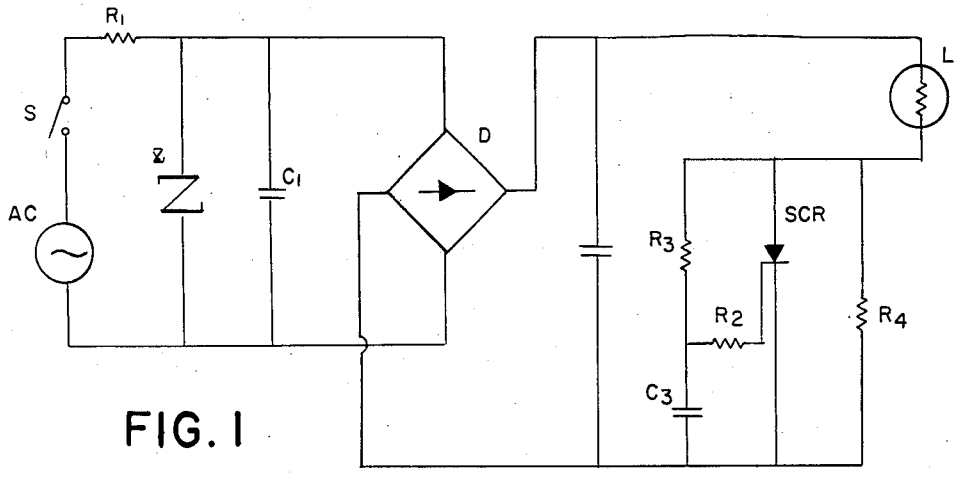
FIG. 1
FIG. 2
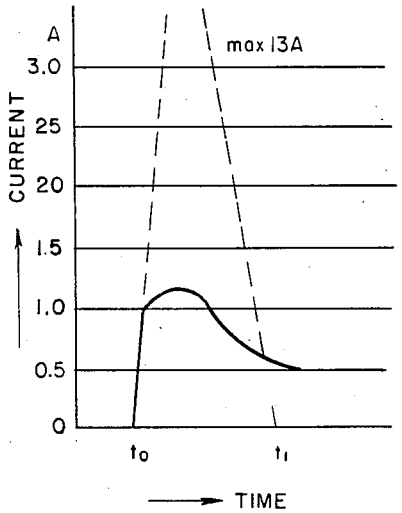
FIG. 3
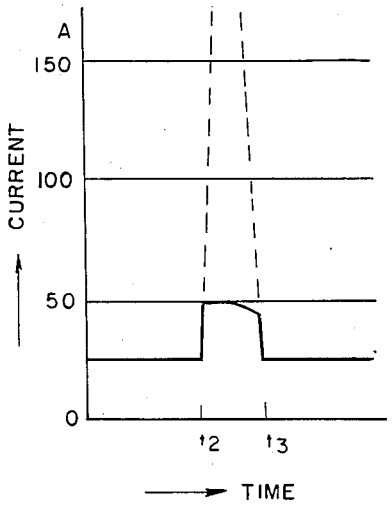
FIG. 4
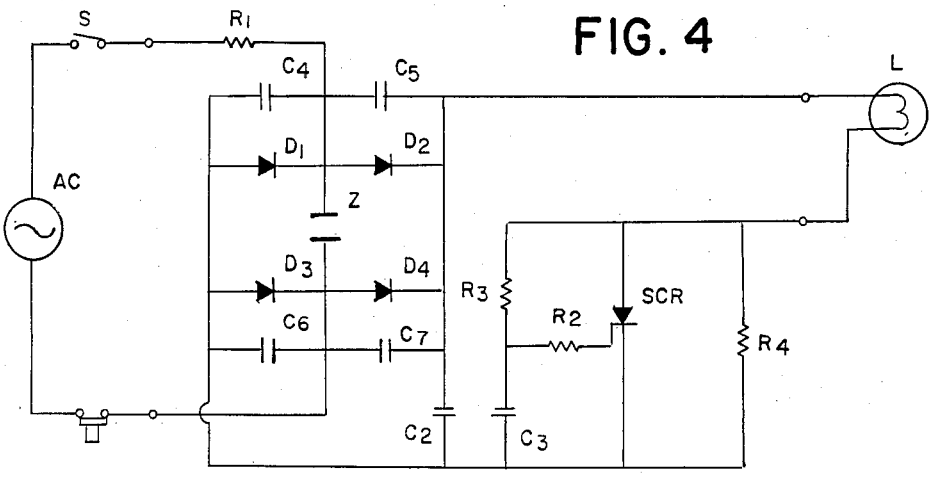

APPARATUS FOR LIMITING SURGE CURRENTS IN DC-ILLUMINATED INCANDESCENT LAMP

FIELD OF THE INVENTION

The present invention relates to an apparatus to limit surge currents which may arise in an incandescent lamp illuminated with dc.

More particularly, the present invention relates to an apparatus to limit an arc discharge current which may flow in dc-illuminated incandescent lamp on filament snapping, as well as to limit a surge current across the lamp filament.

BACKGROUND OF THE INVENTION

When incandescent lamp is dc-illuminated to obtain a flickerless illumination with a high brightness, the filament snapping instantly arises an arc to effect a relatively high discharge current through the filled gas.

The arc occurs almostly under a short-circuited condition because the circuit resistance during the discharge is extremely low. Actual measurement showed that the discharge current was up to 200 amperes when the filament of 60-watt incandescent lamp was snapped during illumination with dc 130 volts. The arc discharge current instantly damages the circuit parts.

BRIEF SUMMARY OF THE INVENTION

In view of the foregoing, the main object of the present invention is to provide a means to limit arc discharge current in dc-illuminated incandescent lamp.

Still another object of the present invention is to provide a means to automatically effect such current limitation.

These and other objects as may become apparent hereinafter have been attained by an apparatus comprising a low resistances (first resistances); another resistance (second resistance); a diode rectifier, the input terminal being connected in series to an ac source through the first resistance, and the output terminal being connected in series to an incandescent lamp through the second resistance; a voltage regulator diode connected in parallel to said diode rectifier; a capacitance (first capacitance) connected in parallel to the input terminal of said diode rectifier; another capacitance (second capacitance) connected in parallel to the output terminal of said diode rectifier; a switching device connected to the second resistance; and a timing circuit connected to said switching device in a manner that the switching device shorts the second resistance after a lapse of a prescribed time upon switching-on of the ac source.

DESCRIPTION OF THE PREFERRED EMBODIMENTS

Several embodiments according to the invention will hereinafter be explained in connection with the accompanying drawings wherein:

FIG. 1 is the basic circuit used in the apparatus according to the invention;

FIG. 2 is the curve of a surge current that flows through lamp filament;

FIG. 3 is the curve of an arc discharge current which may arise in incandescent lamp on filament snapping; and FIG. 4 is a circuit wherein each diode rectifier is equipped with a protection circuit against pulse voltage.

Throughout the accompanying drawings, symbol C designates capacitance; D, diode; L, incandescent lamp; R, resistance; Z, voltage regulator diode; AC, ac power source; and SCR, reverse-blocking triode thyristor.

In the circuit as shown in FIG. 1, ac power source AC energizes voltage regulator diode Z, capacitance $C_1$ (used to absorb pulse voltage), and diode rectifier D through low resistance $R_1$ which is used to limit the surge current into smoothing capacitance. The output voltage of diode D is smoothed into dc by high capacitance $C_2$. Voltage regulator diode Z absorbs abnormal voltages which may occur in the power circuit, while capacitance $C_1$ absorbs high pulse voltages to protect diode rectifier D. The voltage at capacitance $C_2$ is applied between incandescent lamp L and resistance $R_4$ which is connected in series to incandescent lamp L to limit the surge current across the lamp filament.

Since the resistance of lamp filament is generally about 10 ohms when the lamp filament is cold, energization of dc 130 volts to the filament effects an surge current of up to 13 amperes which may snap the filament. Supposing that resistance $R_4$ is set to 100 ohms, the combined resistance becomes 110 ohms (=100 ohms +10 ohms). Energization of dc 130 volts to the combined resistance flows an initial filament current of only 1.2 amperes. Thus, the lamp filament is heated without fear of snapping.

The voltage between resistance $R_4$ simultaneously energizes reverse-blocking triode thyristor SCR, resistance $R_3$ and capacitance $C_3$. Resistance $R_2$ supplies a triggering voltage to the gate of reverse-blocking triode thyristor SCR in accordance with the time constant as determined by resistance $R_3$ and capacitance $C_3$. Triggered thyristor SCR shorts resistance $R_4$, and the full output voltage of capacitance $C_2$ is, therefore, supplied to incandescent lamp L. Incandescent lamp L is illuminated with dc in this way.

The surge current across lamp filament is as shown in FIG. 2: When power switch is closed at time $t_0$, the initial filament current reaches up to 13 amperes as shown with the broken line because the filament resistance is still relatively low. The initial filament current can be suppressed to a safe level of 1.2 amperes by insertion of resistance $R_4$ (100 ohms).

Although the arc discharge current in incandescent lamp L may reach 200 amperes instantly on filament snapping, insertion of resistance $R_1$ (2 ohms) suppresses the discharge current to 50 amperes (=100 volts/2 ohms). Thus, usually-available diodes and thyristors with permissible peak current of 50 amperes can be used without precaution of destruction.

Furthermore, the voltage drop at resistance $R_1$ automatically stops the arc to prevent the discharge current resulting from the arc. After stopping the arc never restores even when power switch is closed because the lamp filament would be sufficiently damaged. If the arc restores, it widens the spark gap at the filament, followed by stopping by resistance $R_1$. Thus, the arc is stopped within a brief time.

Since the apparatus according to the invention instantly and automatically limits arc discharge current in this way, the circuits parts such as thyristor and diodes are prevented from damage or destruction.

The arc discharge circuit is as shown in FIG. 3: The broken line is that of conventional case; and the solid line is that of the case in which the apparatus according to the invention is used.

FIG. 4 illustrates a circuit for protecting diode rectifiers from high pulse voltages which may occur in the power circuit, wherein capacitances $C_4$, $C_5$, $C_6$ and $C_7$ are connected in parallel respectively to diodes $D_1$, $D_2$, $C_3$ and $D_4$ to absorb the pulse voltages.

As described above, the apparatus according to the invention extremely prolongs lamp life because the apparatus effectively limits a surge current that arises on turning-on of power switch.

Furthermore, the apparatus according to the invention prevents a vain destruction of expensive circuit parts other than incandescent lamp, such as diode, thyristor, distribution line and fuse because the apparatus instantly and automatically limits arc discharge current.

In addition, since the apparatus is simple, but very effective in limitation of surge currents, the apparatus can be advantageously used in illumination apparatuses wherein incandescent lamp is illuminated with dc to provide an illumination of high brightness, as well as in illumination apparatuses such as those for vehicles, microscope and photograph.

While I have shown and described particular embodiments of my invention, it will be obvious to those skilled in the art that various changes and modifications may be made without departing from my invention in its broader aspects and I, therefore, intend in the appended claims to cover all such changes and modifications as fall within the true spirit and scope of my invention.

I claim:

1. An apparatus to limit surge currents in a dc-illuminated incandescent lamp, comprising:

(a) a first resistance with a resistance value that is large enough to prevent arc discharge in said dc-illuminated incandescent lamp if its filament is broken;

(b) a second resistance with higher resistance value than said first resistance;

(c) a diode rectifier, having input terminals for power input thereto that are connected in series with an power ac source through said first resistance, and an output terminal that is connected in series with an incandescent lamp through said second resistance, for providing power for illuminating said incandescent lamp;

(d) a voltage regulator diode connected in parallel across said input terminals of said diode rectifier;

(e) a first capacitance connected in parallel to across said input terminals of said diode rectifier;

(f) a second capacitance connected in parallel across said output terminals of said diode rectifier;

(g) a switching device connected in parallel to said second resistance; and (h) a timing circuit connected to said switching device in a manner that the switching device shorts the second resistance after a lapse of a prescribed time upon switching-on of ac power source.

2. The apparatus in accordance with claim 1, wherein said timing circuit is an RC-time constant circuit.

3. The apparatus in accordance with claim 1, wherein said switching device is a reverse-blocking triode thyristor.

4. The apparatus of claim 1, wherein a voltage regulator diode is connected in parallel with the input terminal of the diode rectifier.

* * * * *